US007114558B2

(12) United States Patent
Hoffman et al.

(10) Patent No.: US 7,114,558 B2
(45) Date of Patent: Oct. 3, 2006

(54) FILTERED ACTUATOR PORT FOR HYDRAULICALLY ACTUATED DOWNHOLE TOOLS

(75) Inventors: Corey Hoffman, Magnolia, TX (US); Jason Ellis, Houston, TX (US); David Laurel, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 201 days.

(21) Appl. No.: 10/726,274

(22) Filed: Dec. 2, 2003

(65) Prior Publication Data

US 2004/0129421 A1 Jul. 8, 2004

Related U.S. Application Data

(60) Continuation-in-part of application No. 10/073,685, filed on Feb. 11, 2002, now Pat. No. 6,695,057, which is a continuation-in-part of application No. 09/858,153, filed on May 15, 2001, now abandoned, which is a division of application No. 09/435,388, filed on Nov. 6, 1999, now Pat. No. 6,253,856.

(51) Int. Cl.
*E21B 33/124* (2006.01)

(52) U.S. Cl. ..... 166/126; 166/184; 166/186

(58) Field of Classification Search ..... 166/264, 166/373, 381, 383, 90.1, 123, 126–131, 152, 166/184–186

See application file for complete search history.

(56) References Cited

U.S. PATENT DOCUMENTS 3,517,741 A * 6/1970 Roeder ..... 166/106
3,540,814 A * 11/1970 Roeder ..... 417/399
6,253,856 B1 7/2001 Ingram et al.
6,257,339 B1 7/2001 Haugen et al.
6,364,037 B1 4/2002 Brunnert et al.
6,371,210 B1 4/2002 Bode et al.
6,550,551 B1 4/2003 Brunnert et al.
6,695,057 B1 2/2004 Ingram et al.
6,736,214 B1 5/2004 Hoffman et al.
6,907,936 B1 * 6/2005 Fehr et al. ..... 166/387

OTHER PUBLICATIONS

U.K. Search Report, Application No. GB 0426384.4, dated Feb. 10, 2005.

* cited by examiner

*Primary Examiner*—Frank Tsay
(74) *Attorney, Agent, or Firm*—Patterson & Sheridan, L.L.P.

(57) ABSTRACT

Methods of using and making and apparatuses utilizing a filtered actuator port for hydraulically actuated down hole tools. The filtered port prevents sand or other debris from entering the actuator workings of a tool. In accordance with one aspect of the invention, hydraulic tools utilizing filtered actuator ports are disclosed. In a second aspect, the filtered port comprises fine slots disposed through a wall of a mandrel spaced around the circumference of the mandrel. In a third aspect, the inlet port is formed by laser cutting or electrical discharge machining. In a fourth aspect, the filtered port is disposed in various components of a fracture pack-off system. Methods of using the fracture pack-off system utilizing the filtered port are provided.

22 Claims, 8 Drawing Sheets

FILTERED ACTUATOR PORT FOR HYDRAULICALLY ACTUATED DOWNHOLE TOOLS

CROSS-REFERENCE TO RELATED APPLICATIONS

This application is a continuation-in-part of U.S. patent application Ser. No. 10/073,685, filed Feb. 11, 2002, now U.S. Pat. No. 6,695,057 which is a continuation-in-part of U.S. patent application Ser. No. 09/858,153, filed May 15, 2001, now abandoned, which is a divisional of U.S. patent application Ser. No. 09/435,388, filed Nov. 6, 1999, which is now U.S. Pat. No. 6,253,856, issued Jul. 3, 2001. All of which are herein incorporated by reference in their entireties.

BACKGROUND OF THE INVENTION

1. Field of the Invention

This invention is related to downhole tools for a hydrocarbon wellbore. More particularly, the invention relates to an apparatus useful in conducting a fracturing or other wellbore treating operation. More particularly still, this invention relates to a filtered inlet port through which a wellbore treating fluid such as a "frac" fluid may be pumped without obstructing the workings of a hydraulic tool.

2. Description of the Related Art

In the drilling of oil and gas wells, a wellbore is formed using a drill bit that is urged downwardly at a lower end of a drill string. When the well is drilled to a first designated depth, a first string of casing is run into the wellbore. The first string of casing is hung from the surface, and then cement is circulated into the annulus behind the casing. Typically, the well is drilled to a second designated depth after the first string of casing is set in the wellbore. A second string of casing, or liner, is run into the wellbore to the second designated depth. This process may be repeated with additional liner strings until the well has been drilled to total depth. In this manner, wells are typically formed with two or more strings of casing having an ever-decreasing diameter.

After a well has been drilled, it is desirable to provide a flow path for hydrocarbons from the surrounding formation into the newly formed wellbore. Therefore, after all casing has been set, perforations are shot through the liner string at a depth which equates to the anticipated depth of hydrocarbons. Alternatively, a liner having pre-formed slots may be run into the hole as casing. Alternatively still, a lower portion of the wellbore may remain uncased so that the formation and fluids residing therein remain exposed to the wellbore.

In many instances, either before or after production has begun, it is desirable to inject a treating fluid into the surrounding formation at particular depths. Such a depth is sometimes referred to as "an area of interest" in a formation. Various treating fluids are known, such as acids, polymers, and fracturing fluids.

In order to treat an area of interest, it is desirable to "straddle" the area of interest within the wellbore. This is typically done by "packing off" the wellbore above and below the area of interest. To accomplish this, a first packer having a packing element is set above the area of interest, and a second packer also having a packing element is set below the area of interest. Treating fluids can then be injected under pressure into the formation between the two set packers.

A variety of pack-off tools are available which include two selectively-settable and spaced-apart packing elements. Several such prior art tools use a piston or pistons movable in response to hydraulic pressure in order to actuate the setting apparatus for the packing elements. However, debris or other material can block or clog the piston apparatus, inhibiting or preventing setting of the packing elements. Such debris can also prevent the un-setting or release of the packing elements. This is particularly true during fracturing operations, or "frac jobs," which utilize sand or granular aggregate as part of the formation treatment fluid.

Prior solutions to the debris problem have included running in a filter or screen above the down-hole tool. This has several disadvantages. First, once the screen is run above the down-hole tool, full pressure can no longer be transmitted to the piston. Second, emergency release mechanisms and other devices actuated by a ball cannot be used.

There is, therefore, a need for a hydraulic down-hole tool which does not require a piston susceptible to becoming clogged by sand or other debris.

SUMMARY OF THE INVENTION

The present invention generally discloses a novel actuator port for use in a hydraulic wellbore tool, a method of making the actuator port, and methods of using the actuator port. The actuator port filters out particulates so they do not obstruct the workings of the actuator. The filtered port may comprise fine slots disposed through a wall of a mandrel spaced around the circumference of the mandrel.

The present invention introduces a hydraulic tool for use in a wellbore, comprising: a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion.

The present invention discloses forming at least one filter slot in the tubular wall utilizing manufacturing methods including but not limited to electrical discharge machining and laser cutting.

The present invention may be incorporated into any kind of hydraulic tool, including but not limited to a packer comprising a packing element and a fracture valve comprising a fracture port. These may be provided into a pack-off system comprising an upper packer, a fracture valve, and a lower packer all utilizing the present invention. The pack-off system may include other components as well.

The pack-off system utilizing the present invention may be run into a wellbore where the packing elements are set and the fracture port is opened by injecting fluid into the packer system under various flow rates resulting in various pressures. Further, an actuating fluid may be used to set the packers and open the fracture valve, and then treatment fluid may be injected through a fracture port into the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3A is the system in the run in position. FIG. 3B is the system after the nozzle valve has been closed. FIG. 3C is the system after the packers have been set. FIG. 3D is the system after opening of the fracture valve.

DETAILED DESCRIPTION OF THE PREFERRED EMBODIMENT

Figure 1:
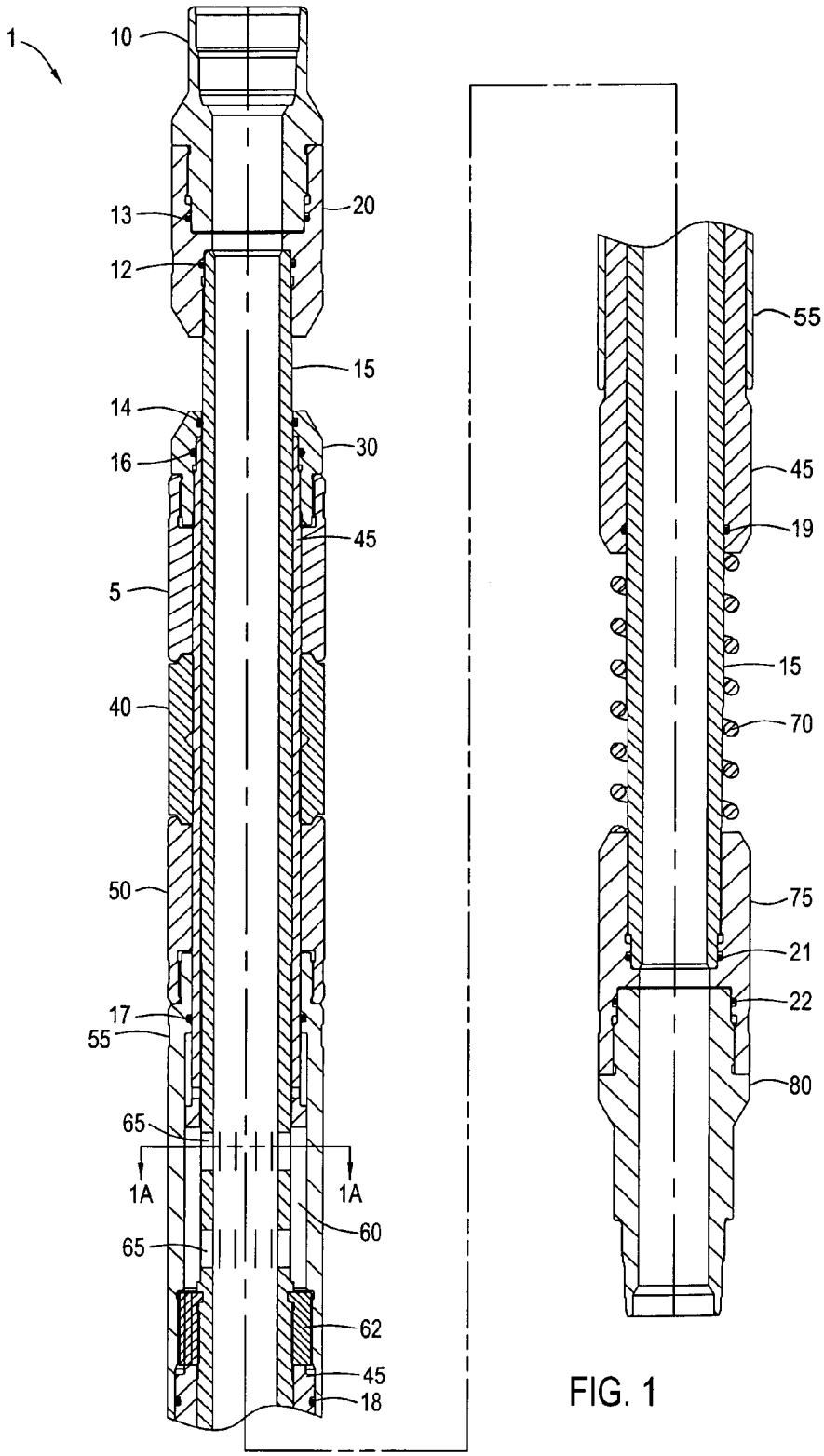
FIG. 1 is a view of one cross-section of a hydraulic packer utilizing a filtered actuator according to one embodiment of the present invention.

FIG. 1 presents a sectional view of a hydraulic packer 1 as might be used with a filtered port of the present invention. The packer is seen in a run in configuration. The packer 1 first comprises a packing element 40. The packing element 40 may be made of any suitable resilient material, including but not limited to any suitable elastomeric or polymeric material. Actuation of the packing element below a workstring (not shown) is accomplished, in one aspect, through the application of hydraulic pressure.

Figure 2:
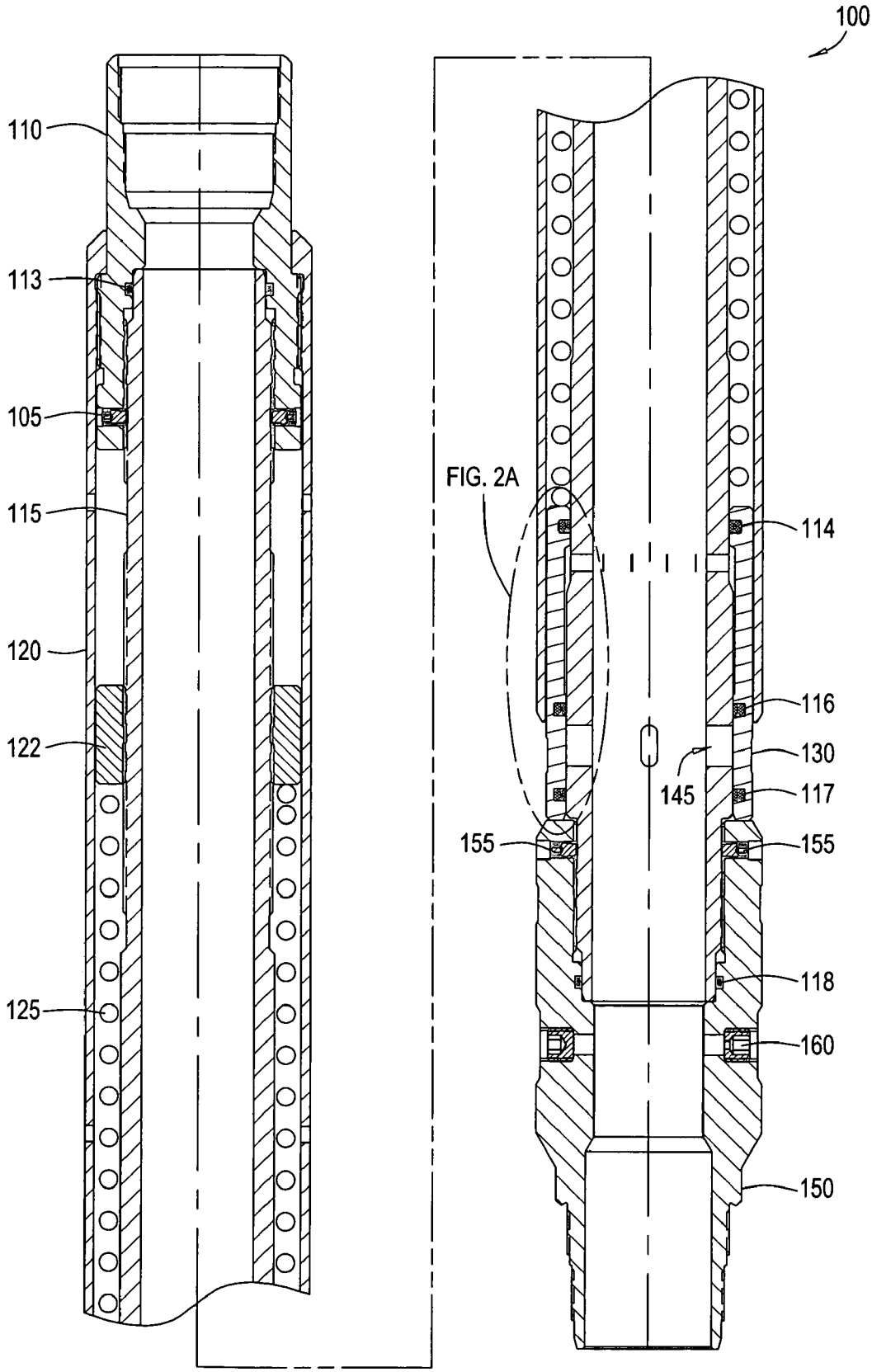
FIG. 2 is a cross-sectional view of a fracture valve utilizing a filtered actuator according to one embodiment of the present invention.

Visible at the top of the packer 1 in FIG. 1 is a top sub 10. The top sub 10 is a generally cylindrical body having a flow bore therethrough. The top sub 10 is threadedly connected at a top end to the workstring (not shown) or a fracture valve (as shown in FIG. 2). At a lower end, the top sub 10 is threadedly connected to an element adapter 20. The element adapter 20 defines a tubular body surrounding a lower portion of the top sub 10. An o-ring 13 seals a top sub 10/element adapter 20 interface. At a lower end, the element adapter 20 is threadedly connected to a center mandrel 15. The center mandrel 15 defines a tubular body having a flow bore therethrough. The lower end of the element adapter 20 surrounds an upper end of the center mandrel 15. One or more o-rings may be used to seal the various interfaces of the packer 1. In one embodiment, an o-ring 12 seals an element adapter 20/center mandrel 15 interface.

The packer 1 shown in FIG. 1 also includes a packing element compressor 30 and a piston 45. The packing element compressor 30 and the piston 45 each generally define a cylindrical body and each surround a portion of the center mandrel 15. An o-ring 14 seals a packing element compressor 30/center mandrel 15 interface. An upper end of the piston 45 is disposed within and threadedly connected to the packing element compressor 20. An o-ring 16 seals a packing element compressor 30/piston 45 interface. Surrounding a lower end of the packing element compressor 30 and threadedly connected thereto is an upper gage ring 5. The upper gage ring 5 defines a tubular body and also surrounds a portion of the piston 45. At a lower end, the upper gage ring 5 comprises a retaining lip that mates with a corresponding retaining lip at an upper end of the packing element 40. The lip of the upper gage ring 5 aids in forcing the extrusion of the packing element 40 outwardly into contact with the surrounding casing (not shown) when the packing element 40 is set.

At a lower end, the packing element 40 comprises another retaining lip which corresponds with a retaining lip comprised on an upper end of a lower gage ring 50. The lower gage ring 50 defines a tubular body and surrounds a portion of the piston 45. At a lower end, the lower gage ring 50 surrounds and is threadedly connected to an upper end of a center case 55. The center case 55 defines a tubular body which surrounds a portion of the piston 45. Within the center case 55, the piston 45 defines a chamber 60. Corresponding to the chamber 60 is a filtered inlet port 65 disposed through a wall of the center mandrel 15. Preferably, the filtered inlet port 65 comprises two sets of filter slots.

Figure 1A:
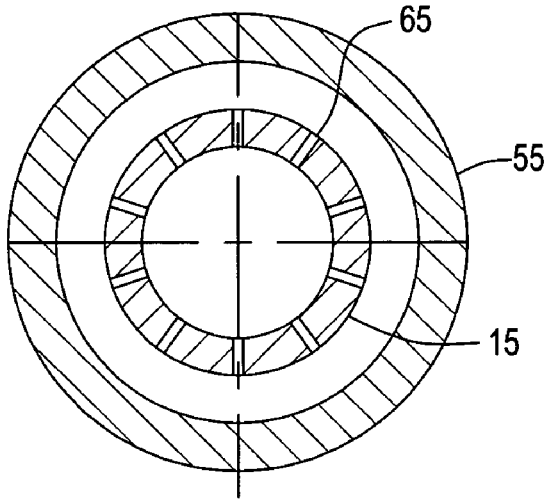
FIG. 1A is a section of FIG. 1 detailing a filtered inlet port.

Each filter slot 65 is configured to allow fluid to flow through but to prevent the passage of particulates. Preferably, the filter slots are substantially rectangular in shape. In one embodiment shown in FIG. 1A, ten filter slots 65 are equally spaced around the entire circumference of the center mandrel for each set of inlet slots. The filter slots 65 can be cut into the center mandrel 15 using a laser or electrical discharge machining (EDM). The dimensions and number of slots may vary depending on the size of the particulates expected in the fracture fluid. As an example, for a fracture fluid with a minimum particulate size of 0.016 inch in diameter, each filter slot 65 would preferably be 0.9 inch long and between 0.006–0.012 inch wide. Optionally, the width of the slot 65 may be reduced down to 0.003 inch or as far as current manufacturing technology will allow. Typically, a maximum slot width of 0.02–0.03 inch would be expected, however, a width of 0.2 inch would also fall within the scope of the present invention. Use of the term "width" does not mean that the slot 65 must be rectangular. Other shapes can be used for the filter slots 65, such as triangles, ellipses, squares, and circles. In those cases the "width" would be the smallest dimension across the slot 65 (not including the thickness of the slot through the mandrel 15). Other manufacturing techniques may be used to form the filtered inlet port 65, such as the formation of a powdered metal screen or the manufacture of a sintered powdered metal sleeve with the non-flow areas of the sintered sleeve being made impervious to flow.

Disposed within the inlet slot 60 are blocks 62. Preferably, the blocks 62 are annular plates which are threaded on both sides. The outer threads of the blocks 62 mate with threads disposed on an inner side of the center case 55. The inner threads of the blocks 62 mate with threads disposed on an outer side of the center mandrel 15. The blocks are disposed on the center mandrel 15 just below a lower set of filtered inlet slots 65. Preferably, the blocks 62 further comprise a tongue disposed on an upper end for mating with a groove disposed on the outside of the central mandrel 15. Preferably, the blocks 62 do not completely fill the inlet slot 60, thereby leaving a gap allowing fluid to flow around the blocks within the inlet slot.

An o-ring 17 seals an upper piston 45/center case 55 interface. An o-ring 18 seals a lower piston 45/center case 55 interface. An o-ring 19 seals a piston 45/center mandrel 15 interface. Abutting a lower end of the piston 45 is an upper end of a biasing member 70. Preferably, the biasing member 70 comprises a spring. The spring 70 is disposed on the outside of the center mandrel 15. The lower end of the spring 70 abuts an upper end of a spring adapter 75. The spring adapter 75 defines a tubular body. At an upper end, the spring adapter 75 surrounds and is threadedly connected to a lower end of the central mandrel 15. At a lower end, the spring adapter 75 surrounds and is threadedly connected to a bottom sub 80. The bottom sub 80 defines a tubular body having a flow bore therethrough. An o-ring 21 seals a spring adapter 75/center mandrel 15 interface. A lower end of the bottom sub 80 is threaded so that it may be connected to other members of the workstring such as a nozzle valve 85

Figure 1B:
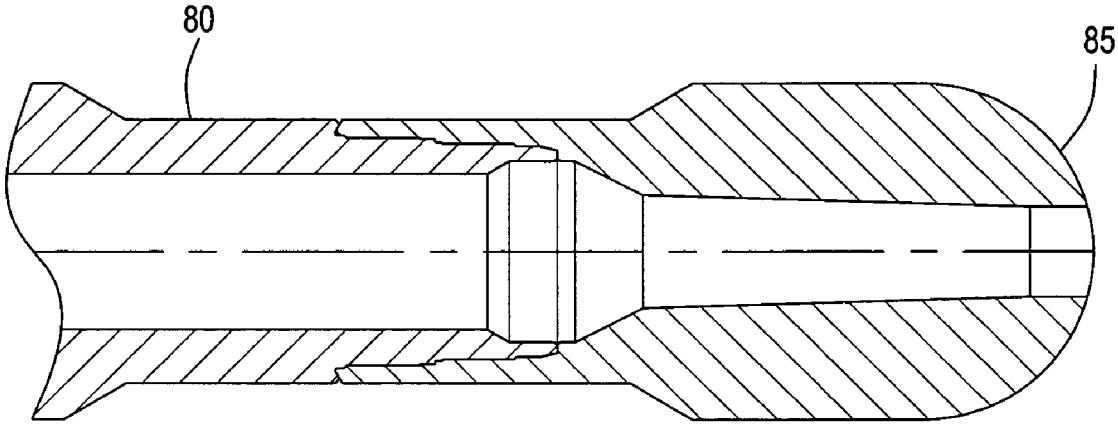
FIG. 1B is a cross-sectional view of a nozzle valve.

(as illustrated in FIG. 1B), or a fracture valve (as displayed in FIG. 2). An o-ring 22 seals a spring adapter 75/bottom sub 80 interface. FIG. 1B contains a cross sectional view of the nozzle valve 85. The nozzle valve 85 comprises a flow bore therethrough with a tapered seat for a ball that may be dropped through the workstring.

FIG. 2 presents a sectional view of a fracture valve 100 as might be used with a filtered port of the present invention. The fracture valve 100 is seen in a run in configuration. Visible at the top of the fracture valve 100 in FIG. 1 is a top sub 110. The top sub 110 is a generally cylindrical body having a flow bore therethrough. The top sub 110 is threadedly connected at a top end to the workstring (not shown) or a packer (as shown in FIG. 1).

Figure 2A:
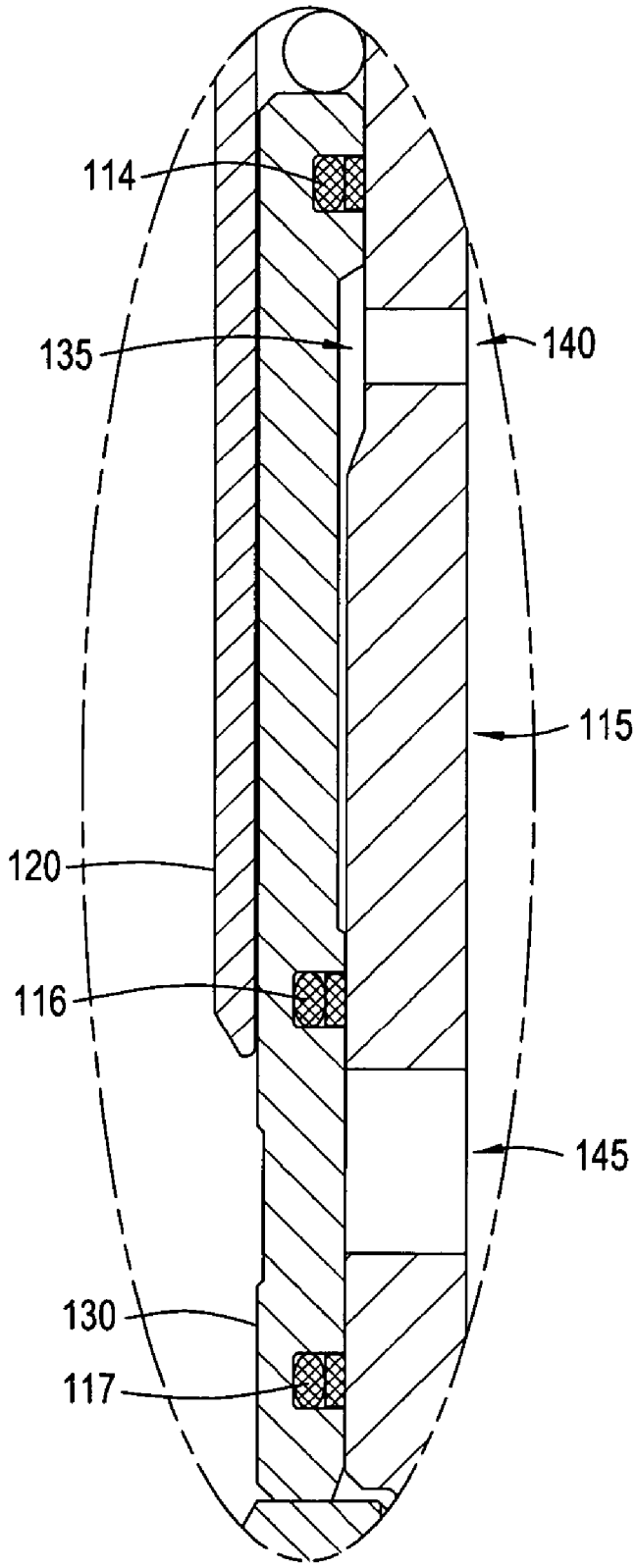
FIG. 2A is an enlargement of a piston/mandrel interface of FIG. 2.

At a lower end, the top sub 110 surrounds and is threadedly connected to an upper end of a mandrel 115. The mandrel 115 defines a tubular body having a flow bore therethrough. Set screws 105 optionally prevent unthreading of the top sub 110 from the mandrel 115. An o-ring 113 seals a top sub 110/mandrel 115 interface. Also at the lower end, the top sub 110 is surrounded by and threadedly connected to an upper end of a sleeve 120. The sleeve 120 defines a tubular body with a bore therethrough. Disposed between the mandrel 115 and the sleeve 120 below the top sub is an adjusting nut 122. The adjusting nut 122 is threadedly connected to the mandrel 115. Abutting a lower end of the adjusting nut 122 is an upper end of a biasing member 125. Preferably, the biasing member 125 comprises a spring. Abutting a lower end of the spring 125 is a piston 130. FIG. 2A is an enlarged partial view of a piston 130/mandrel 115 interface. The piston 130 and the mandrel 115 define a chamber 135. Corresponding to the chamber 135 is a filtered inlet port 140 disposed through a wall of the mandrel 115. Preferably, the filtered inlet port 140 comprises one set of filter slots. Each filter slot 140 is similar to the filter slot 65 discussed above with reference to the packer 1. Disposed in the wall of the mandrel 115 below the filter slots 140 is a fracture port 145. An upper o-ring 114 and a middle o-ring 116 cooperate to seal a piston 130/mandrel 115 interface above the fracture port 145. The middle o-ring 116 and a lower o-ring 117 cooperate to seal the piston 130/mandrel 115 interface proximate the fracture port 145. Abutting a lower end of the piston 130 is a bottom sub 150. The bottom sub 150 is a generally cylindrical body having a flow bore therethrough. At an upper end, the bottom sub 150 surrounds and is threadedly connected to a lower end of the mandrel 115. Set screws 155 optionally prevent unthreading of the bottom sub 150 from the mandrel 115. An o-ring 118 seals a bottom sub 150/mandrel 115 interface. Disposed below the bottom sub 150/mandrel 115 interface in a wall of the bottom sub 150 are jet nozzles 160. At a lower end, the bottom sub 150 is threaded so that it may be connected to the workstring or other members thereof, such as a packer (as displayed in FIG. 1).

Referring to FIGS. 3A–3D, in operation, the packer 1 and the fracture valve 100 are run into the wellbore on the workstring, such as a string of coiled tubing, as part of a pack-off system 200. The workstring is any suitable tubular useful for running tools into a wellbore, including but not limited to jointed tubing, coiled tubing, and drill pipe. The pack-off system 200 comprises a top packer 205, the fracture valve 100, the bottom packer 1, and the nozzle valve 85 or a solid nose portion (not shown). It is understood that additional tools, such as an unloader (not shown) may be used with the pack-off system 200 on the workstring. Preferably, the top packer 205 is a slightly modified version of the bottom packer 1. The top sub and the bottom sub are exchanged enabling the top packer to be mounted upside down in the workstring. The pack-off system may also comprise a spacer pipe (not shown) between the two packers.

Figure 3A:
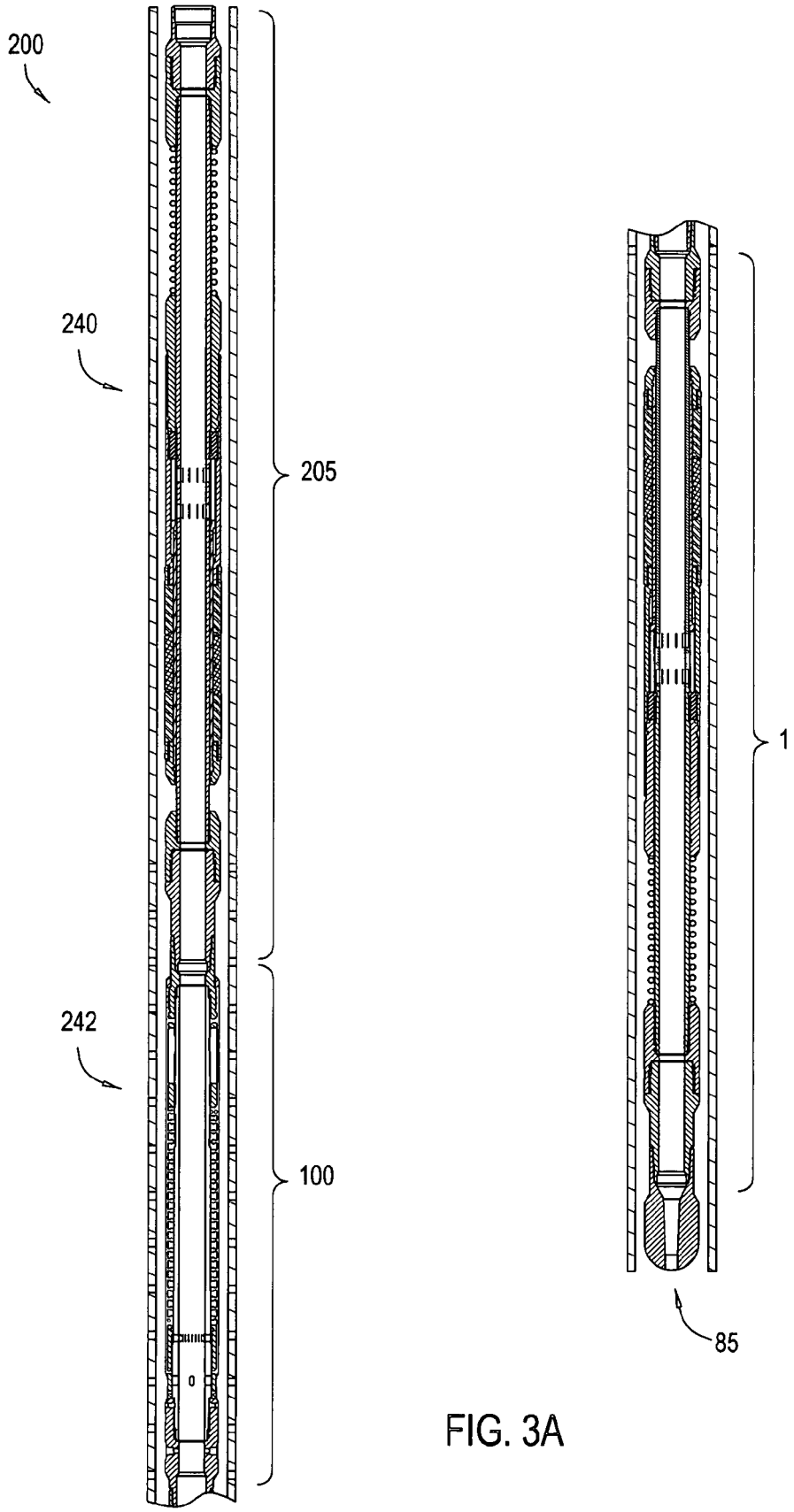
FIGS. 3A–3D are section views of a completed pack-off system.
Figure 3B:
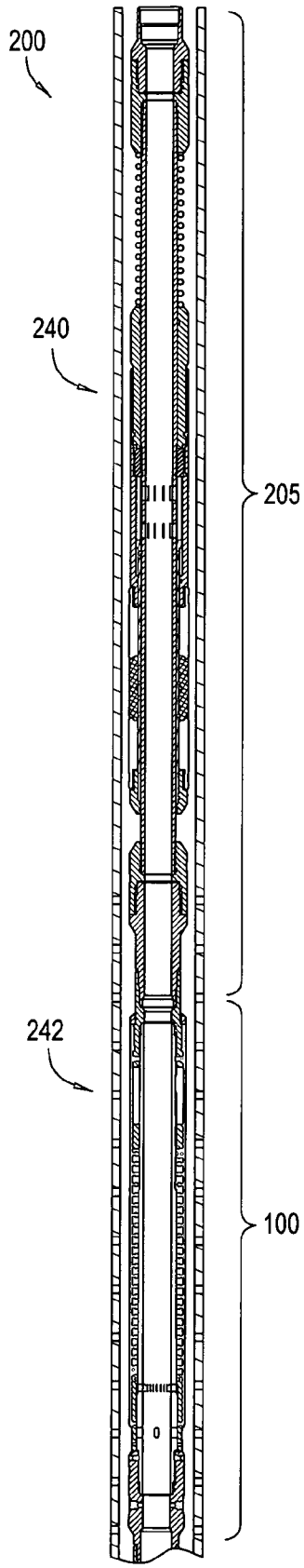
Figure 3B:
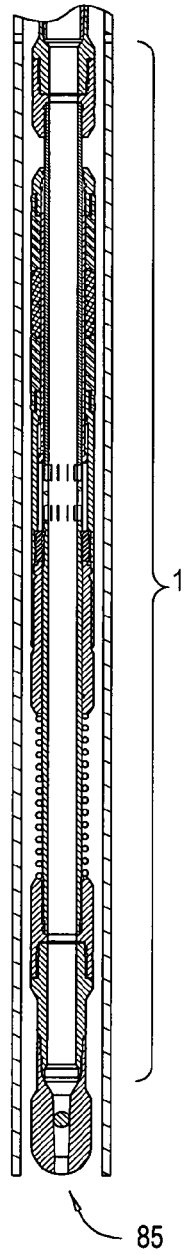
Figure 3C:
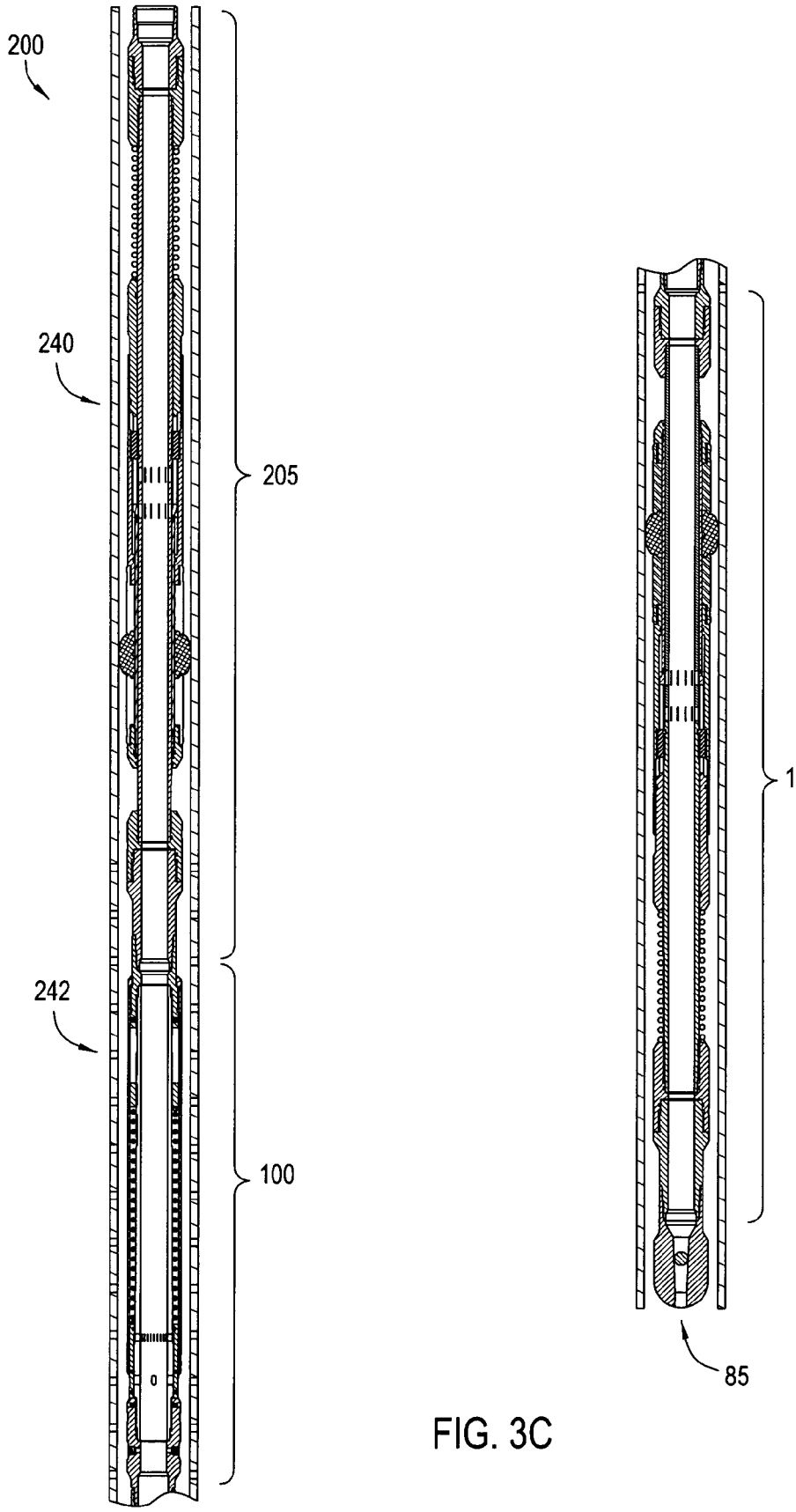

In FIG. 3A, the pack-off system 200 is positioned adjacent an area of interest, such as perforations 242 within a casing string 240. Once the pack-off system 200 has been located at the desired depth in the wellbore, a ball is dropped from the surface into the pack-off system 200 to seal the nozzle valve as shown in FIG. 3B. Fluid is injected into the system at a first flow rate sufficient to set the packers 1 and 205. Because the flow of fluid out of the bottom of the pack-off system 200 is closed off, fluid is forced to exit the system 200 through the jet nozzles 160 of the fracture valve 100. Flow through the jet nozzles 160 will generate a back pressure within the system. Fluid, under this back pressure, also enters the piston chambers 60 and 135 through the filter slots 65 and 140 of the packers 1 and 205 and fracture valve 100 respectively. The filter slots 65 and 140 prevent any debris in the fluid from entering the piston chambers 60 and 135. The pistons 45 and 130 are configured such that one face of the pistons within the chambers 60 and 135 is larger than the other. This will create a net force, generated by the pressure, on the larger piston faces. This force will be opposed by the springs 70 and 125 and, in the packers 1 and 205, the packing elements 40. Once the pressure is sufficient to overcome the opposing forces (the spring force of the fracture valve 100 is greater than that of the packers 1 and 205), it will force the pistons 45 of the upper 205 and lower 1 packers downward (upward for the upper packer) since the system 200 and thus the center mandrels 15, blocks 62, center cases 55, and lower gage rings 50 are held in place by the workstring. This forces the packing element compressors 30 and upper gage rings 5 to move downwardly (upwardly for the upper packer). The upper gage rings 5 push down (up for the upper packer) to set the packing elements 40 of the upper and lower packers 1 and 205. The packing elements 40 are shown set within the casing 240 in FIG. 3C.

Figure 3D:
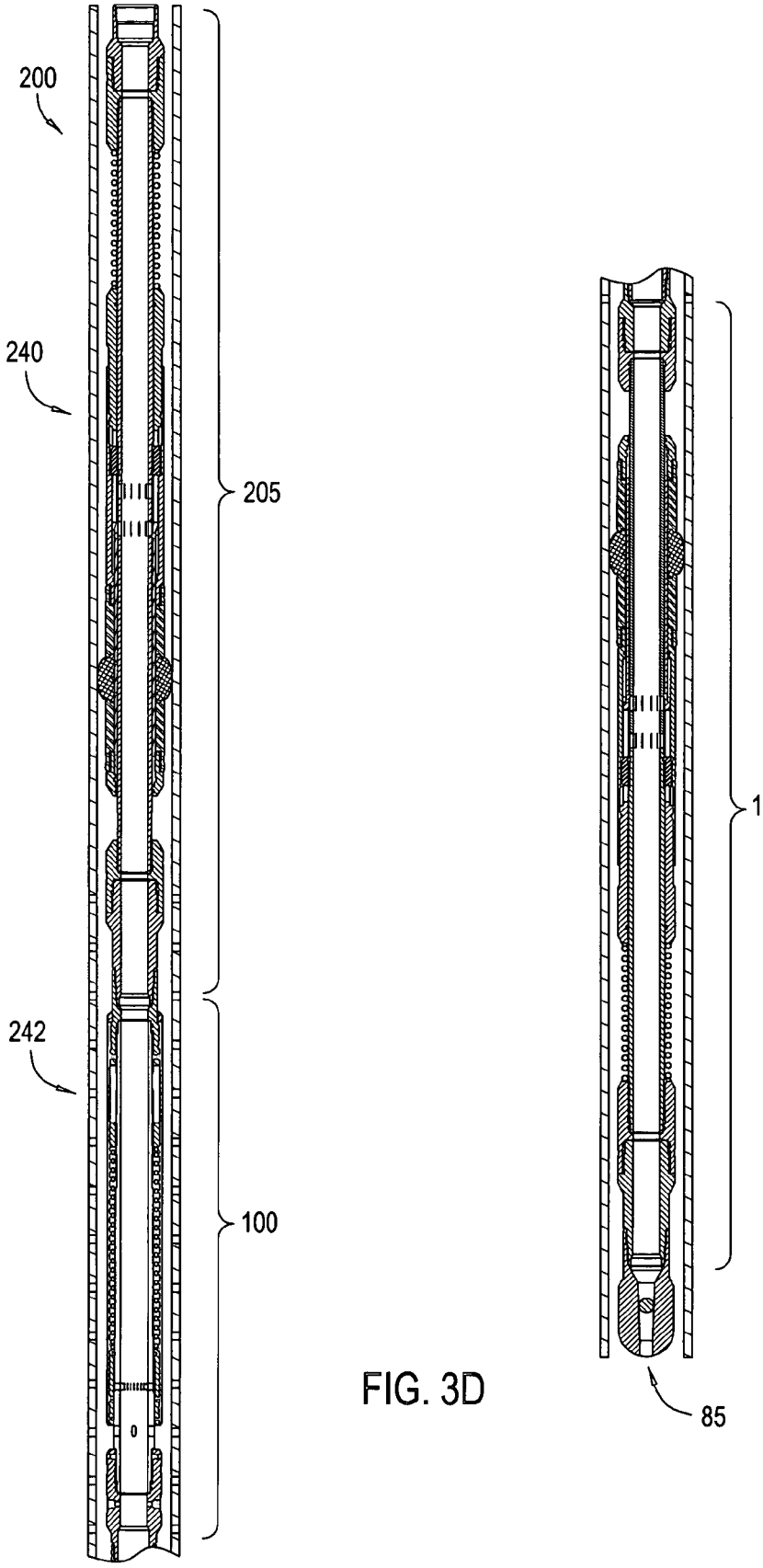

After sufficient pressure has been applied to the pack-off system 200 through the bores of the center mandrels 15 to set the packing elements 40, the fluid injection rate is increased into the system 200. From there fluid enters the annular region between the pack-off system 200 and the surrounding casing 240. The injected fluid is held in the annular region between the packing elements 40 of the upper 205 and lower packers 1. Fluid continues to be injected, at this higher rate, into the system 200 and through the jet nozzles 160 until a greater second pressure level is reached. This second pressure causes the piston 130 of the fracture valve 100 to move upward along the mandrel 115. This, in turn, exposes the fracture port 145 to the annular region between the pack-off system 200 and the surrounding casing 240 as shown in FIG. 3D. A greater volume of fracturing fluid can then be injected into the wellbore so that formation fracturing operations can be further conducted.

If any debris should deposit on the filter slots, it may be purged when the system is reset by de-pressurization. This is due to the fact that as the pistons 45 and 130 are urged back to their run in positions, fluid will be forced from the chambers 60 and 135 of the packers 1 and 205 and fracture valve 100 back through the filtered slots 65 and 140 into the center mandrels 15 and mandrel 115 respectively.

The filtered inlet ports shown in FIGS. 1–3 may be used with any hydraulically operated tool. While the foregoing is directed to embodiments of the present invention, other and further embodiments of the invention may be devised without departing from the basic scope thereof, and the scope thereof is determined by the claims that follow.

The invention claimed is:

1. A pack-off system for use in a wellbore, comprising:

an upper packer, comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member sets a packing element when actuated by fluid; and a lower packer coupled to the upper packer, the lower packer comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member sets a packing element when actuated by fluid.

2. The pack-off system of claim 1, further comprising a fracture valve coupled to the upper packer, the fracture valve comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member exposes a fracture port when actuated by fluid.

3. The system of claim 1, wherein the filter portions each comprise at least one slot and the widths of the slots are no greater than 0.2 inch.

4. The system of claim 3, wherein the slots are substantially rectangular.

5. The system of claim 4, wherein the widths of the slots are less than or equal to 0.03 inch.

6. The system of claim 4, wherein the widths of the slots are less than or equal to 0.012 inch and greater than or equal to 0.006 inch.

7. The system of claim 3, wherein each of the at least one slots comprises at least one set of slots spaced around the circumference of each of the tubular walls.

8. The system of claim 1, wherein each of the packers and the fracture valve further comprise means for purging their respective filter portions of debris.

9. A method for placing fluid into an area of interest within a wellbore, comprising:

running a pack-off system into the wellbore, the system comprising:

an upper packer, comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member sets a packing element when actuated by fluid;

a lower packer coupled to the upper packer, the lower packer comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member sets a packing element when actuated by fluid; and a fracture valve coupled to the upper packer, the fracture valve comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion wherein the actuating member exposes a fracture port when actuated by fluid;

positioning the pack-off system within the wellbore adjacent an area of interest;

flowing fluid into the pack-off system to set the upper and lower packing elements and to expose the fracture port; and placing a fluid into the pack-off system and through the opened fracture port.

10. The method of claim 9, wherein the filter portions each comprise at least one slot and the widths of the slots are no greater than 0.2 inch.

11. The method of claim 10, wherein the slots are substantially rectangular.

12. The method of claim 11, wherein the widths of the slots are less than or equal to 0.03 inch.

13. The method of claim 11, wherein the widths of the slots are less than or equal to 0.012 inch and greater than or equal to 0.006 inch.

14. The method of claim 10, wherein each of the at least one slots comprises at least one set of slots spaced around the circumference of each of the tubular walls.

15. The method of claim 9, wherein each of the packers and the fracture valve further comprise means for purging their respective filter portions of debris.

16. A method for injecting formation treatment fluid into an area of interest within a wellbore, comprising:

running a pack-off system into the wellbore, the system comprising:

an upper packer, comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member sets a packing element when actuated by fluid;

a lower packer coupled to the upper packer, the lower packer comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion, wherein the actuating member sets a packing element when actuated by fluid; and a fracture valve coupled to the upper packer, the fracture valve comprising:

a tubular wall for separating a first fluid containing region from a second fluid containing region, the tubular wall including a filter portion; and an actuating member disposed within the second fluid containing region, the actuating member operable upon contact with a fluid flowing from the first fluid containing region and through the filter portion wherein the actuating member exposes a fracture port when actuated by fluid;

positioning the pack-off system within the wellbore adjacent an area of interest;

injecting an actuating fluid into the pack-off system at a first fluid pressure level so as to set the upper and lower packing elements;

injecting an actuating fluid into the pack-off system at a second greater fluid pressure level so as to expose the fracture port; and injecting a formation treating fluid into the pack-off system through the exposed fracture port.

17. The method of claim 16, wherein the filter portions each comprise at least one slot and the widths of the slots are no greater than 0.2 inch.

18. The method of claim 17, wherein the slots are substantially rectangular.

19. The method of claim 18, wherein the widths of the slots are less than or equal to 0.03 inch.

20. The method of claim 18, wherein the widths of the slots are less than or equal to 0.012 inch and greater than or equal to 0.006 inch.

21. The method of claim 17, wherein each of the at least one slots comprises at least one set of slots spaced around the circumference of each of the tubular walls.

22. The method of claim 16, wherein each of the packers and the fracture valve further comprise means for purging their respective filter portions of debris.

* * * * *